United States Patent [19]

Skaalen

[11] 4,183,502

[45] Jan. 15, 1980

[54] HYDRAULIC CHAIN JACK AUTOMATIC LATCH CONTROL SYSTEM

[75] Inventor: Clifford I. Skaalen, Oxnard, Calif.

[73] Assignee: The United States of America as represented by the Secretary of the Navy, Washington, D.C.

[21] Appl. No.: 916,410

[22] Filed: Jun. 16, 1978

[51] Int. Cl.[2] ..... B66F 1/08

[52] U.S. Cl. ..... 254/110; 254/108

[58] Field of Search ..... 254/105, 107, 108, 110

[56] References Cited

U.S. PATENT DOCUMENTS

| | | | |
|---|---|---|---|
| 3,858,847 | 1/1975 | Chambers | 254/108 |
| 3,860,215 | 1/1975 | Chambers | 254/110 |

*Primary Examiner*—John Sipos
*Assistant Examiner*—W. D. Bray
*Attorney, Agent, or Firm*—Richard S. Sciascia; J. M. St. Amand; Darrell E. Hollis

[57] ABSTRACT

A chain jack utilizing two chains is operated by alternately transferring the chain load from latches incorporated within an upper latch assembly to latches incorporated within a lower latch assembly while moving the upper and lower latch assemblies away from and toward each other by alternate extension and retraction of a hydraulic ram to cause relative movement between the chain and the lower latch assembly. Actuation of the latch mechanism is controlled by hydraulic connection to a pair of four-way valves operated by a control piston having followers from the four-way valves engageable thereon. The control piston is disposed to move with the upper latch assembly while the followers are rigidly affixed to the lower latch assembly. Thus, the engagement and disengagement of the latch mechanisms with the chains are synchronized by the relative movement between the lower and upper latch assemblies.

14 Claims, 15 Drawing Figures

| LOAD MODE | | | | |
|---|---|---|---|---|
| STROKE (INCHES) | UPPER LATCH | | LOWER LATCH | |
| | POSITION | ACTION | POSITION | ACTION |
| 0 | | OUT | | OUT |

| LIFT MODE | | | | | |
|---|---|---|---|---|---|
| | STROKE (INCHES) | UPPER LATCH | | LOWER LATCH | |
| | | POSITION | ACTION | POSITION | ACTION |
| EXTEND | 0 | IN | | IN | |
| | 1 | IN | | IN | OUT |
| | 12 | IN | | OUT | IN |
| | 13½ | IN | | IN | |
| RETRACT | 12 | IN | OUT | IN | |
| | 1 | OUT | IN | IN | |
| | 0 | IN | | IN | |

| LOWER MODE | | | | | |
|---|---|---|---|---|---|
| | STROKE (INCHES) | UPPER LATCH | | LOWER LATCH | |
| | | POSITION | ACTION | POSITION | ACTION |
| EXTEND | 0 | OUT | | IN | |
| | 1 | OUT | | IN | |
| | 12 | OUT | IN | IN | |
| | 13½ | IN | | IN | OUT |
| RETRACT | 12 | IN | | OUT | |
| | 1 | IN | | OUT | IN |
| | 0 | IN | OUT | IN | |

HYDRAULIC CHAIN JACK AUTOMATIC LATCH CONTROL SYSTEM

BACKGROUND OF THE INVENTION

1. Field of the Invention

The present invention relates generally to chain jacks and more particularly to chain jacks utilizing logic control.

2. Prior Art

Chain jacks are used often in marine ship building and construction operations to lift heavy loads precisely and economically. They generally comprise a hydraulic cylinder or base having a piston or ram attached to a head. Moveable latches are attached to, or made as part of, the base and head, each of which engages a chain between links thereof. Actuation of these latches is controlled such that they move alternately in and out of engagement with the chain links as the ram moves in and out of the hydraulic cylinder. The load is sequentially supported by one latch and then the other. Conveniently, the hydraulic cylinder may extend the ram at each stroke at least nominally equivalent to one pitch of the chain. The latch in the ram head will be engaged with the chain during piston extension while the base latch will be released. When the piston has reached the end of its stroke, the base latch engages the chain and the ram head latch is released while the ram contracts. Once contracted, the ram head latch engages the chain and the base latch is released again. The cycle is repeated advancing the chain another short distance.

Such prior art chain jack systems suffer the following limitations. The latch activation is slow due to hydraulic head loss between the control panel and the jack latch mechanism. This results in slower speeds of operation for the jack system. Individual jacks cannot be operated out of synchronization because of the complex latch control operations required when operating several jacks which are not synchronized. Manual control of activation of the latch mechanisms require special precautions of the retract cycle of the chain jacks during that period of time in which the latch mechanisms are extended and retracted prior to the chain jack piston reaching its maximum and minimum limits of travel. In addition, a minimum of four hydraulic lines are required between the powered control console and the jack for latch control functions.

Since chain jacks are most often employed for handling heavy loads, construction of their parts and components must be correspondingly heavy. The latches employed must be strong enough to support the load carried by the jack. To obtain this strength, the thickness of the latches may take up almost all the available space or window between adjacent chain links lying in the same plane. Therefore, very close control of latch actuation is necessary so that each latch enters into engagement and is released from the chain at exactly the proper position of the chain with respect to the cylinder or base and the head of the ram. The present invention provides latch actuation control synchronized with the ram head movement such that one pair of latches cannot be disengaged unless the other pair is supporting the load. In addition, the present invention provides precise control of latch entry into each window between links even when this window is only a small amount wider than the thickness of the latch.

SUMMARY OF THE INVENTION

The present invention overcomes the disadvantages and limitations of the prior art by providing an improved chain jack system. The present invention comprises a chain jack having a pair of chains, an upper latch and lower latch assembly with removeable latch mechanisms attached to the upper and lower latch assemblies. The upper and lower latch assemblies are moved repetitively with respect to each other while the latch mechanisms are actuated in and out of engagement with the chains. The latch mechanism actuation is synchronized with the relative movement between the lower latch assembly and the upper latch assembly to cause relative movement between the lower latch assembly and the chains. Actuation of the latch mechanism is controlled by a control piston having logic surfaces thereon with followers engaging the logic surfaces. The followers actuate hydraulic four-way valves which control actuation of the latch mechanisms such that they move alternately in and out of engagement with the chain links at the proper times. The logic surfaces on the control pistons are so arranged along the control piston surface to actuate the latch mechanisms only when a window or space between links is presented so that accurate engagement with the chains at the proper position is attained. In addition, a control pin engageable with the logic surfaces of the control piston is provided for maintaining the followers in proper alignment and engagement with the logic surfaces on the control piston. Preferably, the latch mechanisms about to enter into engagement with the chain are not urged or biased to enter at a position prior to the actual entry position. The latch mechanisms are constrained to engage the chain only when a window or space is presented. If a latch mechanism is biased to engage or disengage the chain when the barge is heaving in a heavy surf, it is likely that a slack chain may cause a latch mechanism to disengage the chain prematurely sending the barge crashing into the surf resulting in latch failure. When the load is held by a latch mechanism the latch mechanism about to engage the chain will not do so until a window or space between chain links is presented thereto. When the load is taken by the other latch mechanisms the withdrawing latch mechanisms will immediately withdraw but never before the load is taken by the other latch mechanisms. This is arranged by providing a latch actuating force conveniently obtained by use of conventional hydraulic cylinders.

It is therefore an object of the present invention to provide an improved chain jack.

Another object of the present invention is to provide a chain jack having an automatic latch control.

A still further object of the present invention is to eliminate the need for manually controlled latch extensions or retractions during cyclical operation of chain jacks.

A still further object of the present invention is to provide greater jack operation speeds.

Another object of the present invention is to increase reliability and reduce cost.

Another further object of the present invention is to reduce the number of hydraulic control lines between the powered control console and each jack.

Other objects and a more complete appreciation of the present invention and its many intended advantages will develop as the same becomes better understood by reference to the following detailed description when considered in connection with the accompanying drawings in which like reference numerals designate like parts throughout the figures thereof and wherein.

DESCRIPTION OF THE PREFERRED EMBODIMENT

Figure 1:
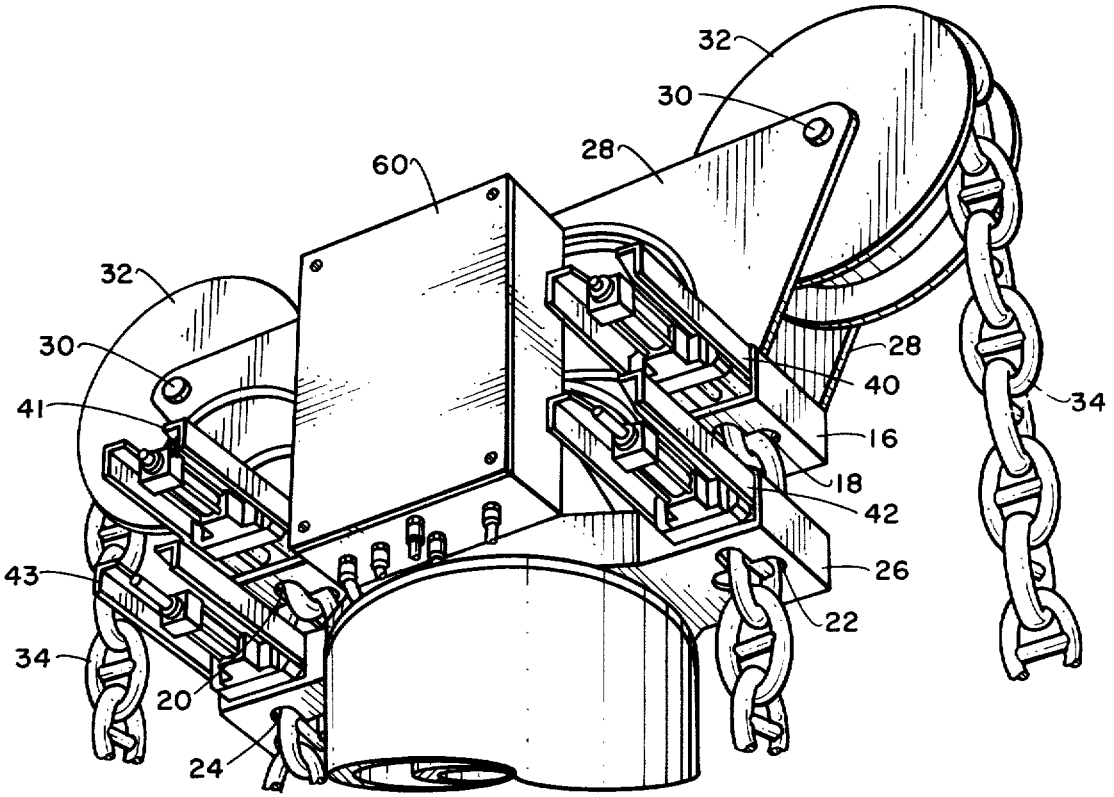
FIG. 1 is a general isometric view of a chain jack embodying features of the present invention.
Figure 2:
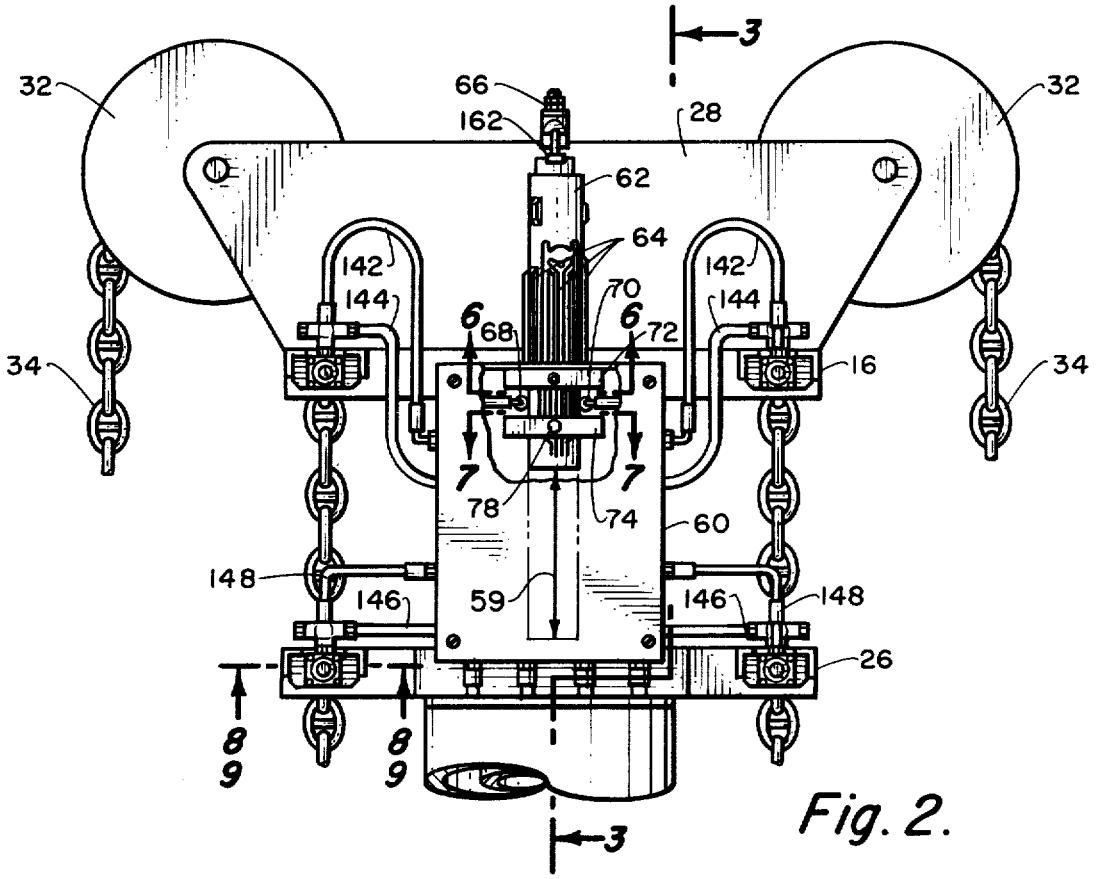
FIG. 2 is a front view of the chain jack of FIG. 1 illustrating movement of the control piston.
Figure 3:
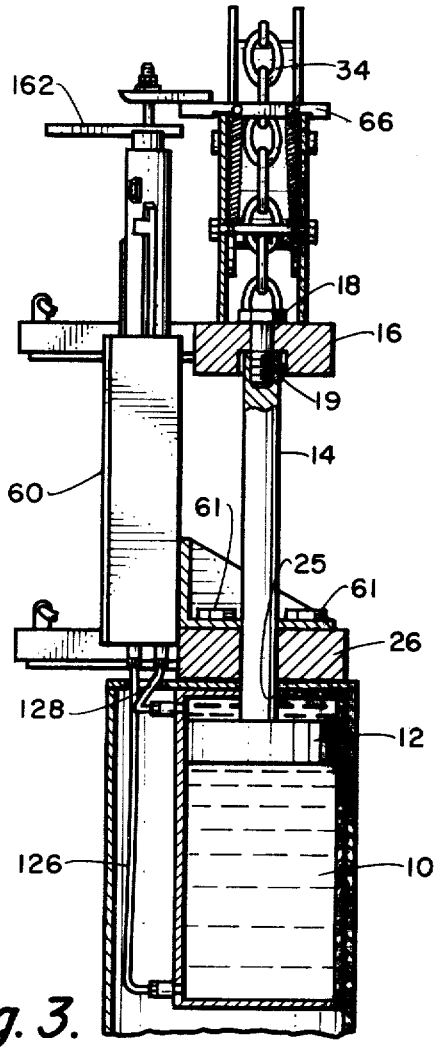
FIG. 3 is a vertical section of the chain jack of FIG. 2 taken along lines 3—3 of FIG. 2.

Referring to the drawings and particularly to FIGS. 1, 2 and 3 the chain jack of the present invention comprises a hydraulic cylinder 10 in which rides a piston 12 to which a rod 14 is suitably rigidly attached. Rod 14 extends upwards through opening 25 of cylinder 10 and is rigidly connected to upper latch assembly 16 through opening 19 therein. Bolt member 18 is utilized to rigidly connect rod 14 to upper latch assembly 16 as shown in FIG. 3.

Upper latch assembly 16 is provided with a pair of cruciform apertures 18 and 20 vertically aligned with similar cruciform apertures 22 and 24 in lower latch assembly 26.

Rigidly attached to the top of upper latch assembly 16 are a pair of parallel outwardly extending sheave supports 28. Shafts 30 are suitably journelled through the outer ends of each support 28 and carry fully rotatable grooved chain sheaves 32. A chain 34 is carried over each of sheaves 32 having its free end simply hanging to provide weight to keep chains 34 in place on sheaves 32 after passing through vertically aligned apertures 18 through 24 in upper and lower latch assemblies 16 and 26.

Figure 8:
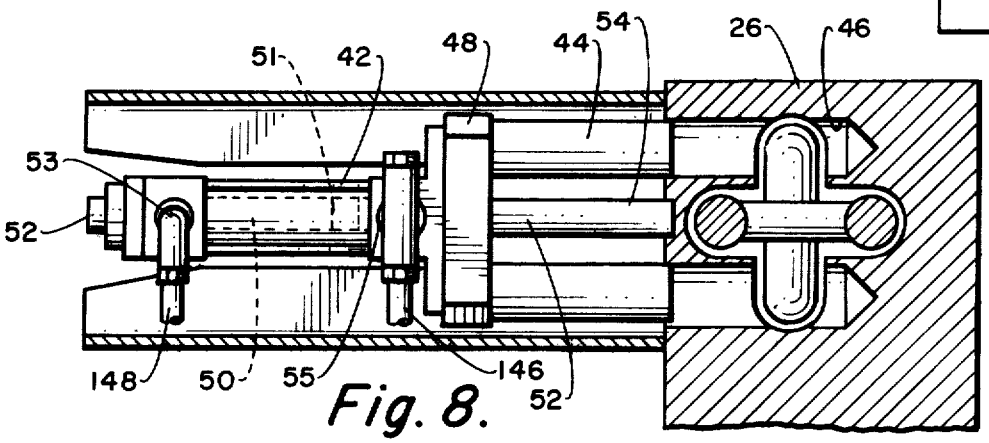
FIG. 8 is a top view of a latch mechanism shown in the embodiment of FIG. 1.
Figure 9:
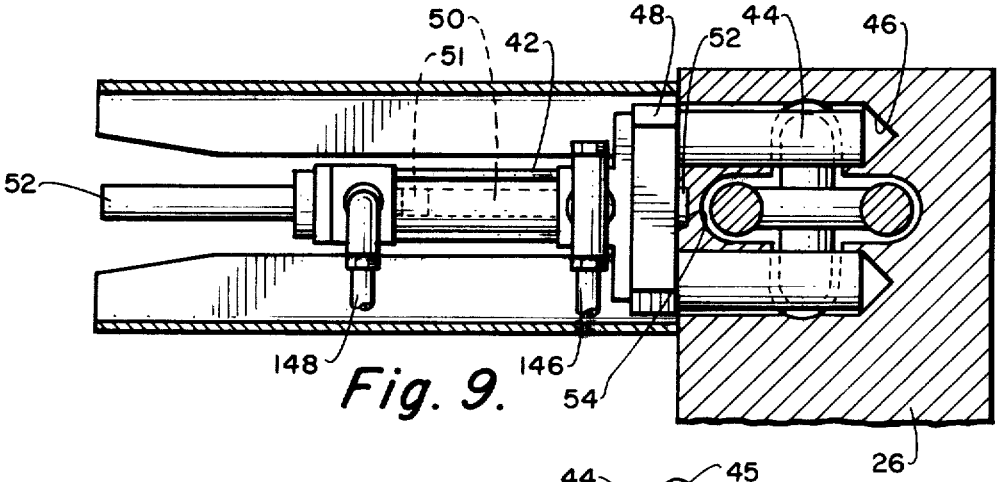
FIG. 9 is a top view of a latch mechanism illustrated in the embodiment of FIG. 1.
Figure 10:
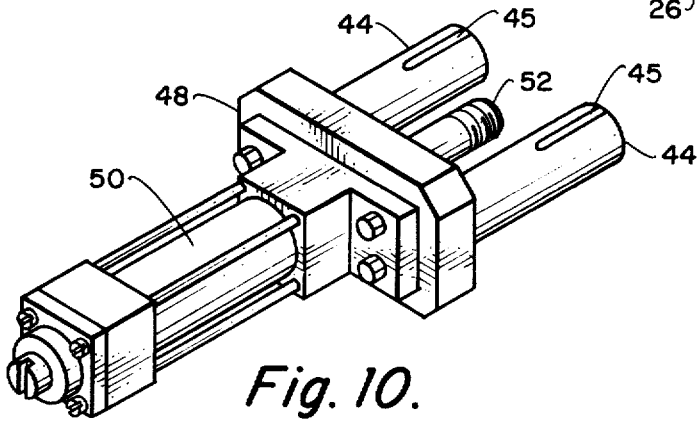
FIG. 10 is an isometric view of the bifurcated latch fingers utilized in a latch mechanism illustrated in FIGS. 8 and 9.

Upper latch assembly 16 is arranged with a pair of latch mechanisms 40 and 41 integral therewith which are illustrated in greater detail in FIGS. 8, 9 and 10. Likewise, lower latch assembly 26 is arranged with a pair of latch mechanisms 42 and 43 integral therewith which are illustrated in greater detail in FIGS. 8, 9 and 10.

As is illustrated in FIGS. 8, 9 and 10, each latch mechanism 40–43 comprises a pair of parallel spaced apart latch pins 44 which are slidably mounted in horizontal holes 46 in upper and lower latch assemblies 16 and 26. The holes 46 are disposed in the way of apertures 18 through 24 with each hole 46 on one side of the center slot for passage of a chain link in the end on position. The outer ends of each pair of latch pins 44 are attached to a mounting plate 48 which is attached to a hydraulic cylinder 50. A threaded piston rod 52 from hydraulic cylinder 50 slidably passes through mounting plate 48. Threaded piston rod 52 is rigidly affixed to lower latch assembly 26 within threaded attachment groove 54.

Hydraulic cylinder 50 includes a piston 51 slidably mounted therein having a piston rod 52 suitably affixed thereto. Hydraulic fluid for driving piston 51 is introduced into hydraulic cylinder 50 through ports 53 and 55 from hydraulic lines 148 and 146, respectively. Hydraulic fluid pressure directed through port 55 via line 146 actuates latch mechanism 42 to engage chain 34 while hydraulic fluid pressure directed through port 53 via line 148 actuates latch mechanism 42 to disengage chain 34.

As is discussed, infra, application of hydraulic fluid pressure through lines 146 and 148 is controlled by four-way valve 136. Four way valve 136 directs hydraulic pressure through either line 148 or line 146 but not both depending upon the positional engagement of cam follower 68 with control piston 62.

Hydraulic lines 146 and 148 also supply hydraulic pressure to actuate latch mechanism 43. Hydraulic lines 142 and 144 supply hydraulic pressure to actuate latch mechanisms 40 and 41 in response to the positional engagement of follower 70 with control piston 62. Four-way valve 134 directs hydraulic fluid into either line 144 or line 142 but not both.

The latch mechanisms 40 and 41 mounted on upper latch assembly 16 are identical to latch mechanisms 42 and 43 mounted on lower latch assembly 26. However, only latch mechanism 42 is illustrated in FIGS. 8, 9 and 10. As shown in FIG. 10, latch pins 44 may be fabricated with flattened areas 45 to facilitate engagement with the links of chain 34.

Figure 6:
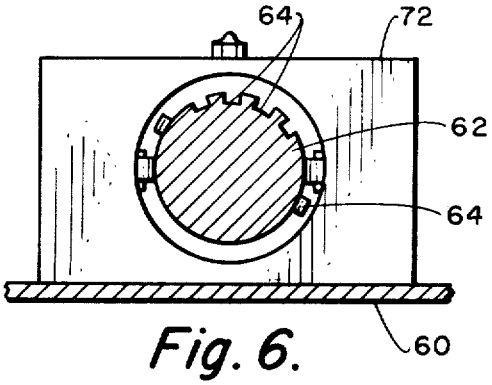
FIG. 6 is a horizontal section of the chain jack of FIG. 2 taken along line 6—6 of FIG. 2.

The relative movement between upper latch assembly 16 and lower latch assembly 26 and the synchronization of the engagement and disengagement of latch mechanisms 40–43 with chains 34 is controlled by the equipment located within control box 60. Control piston 62 is disposed to move vertically with respect to the control box 60 as shown by arrow 59 in FIG. 2 and is coupled to the upper latch assembly 16 via compensator system 66. The compensator system 66 is discussed hereinafter in connection with FIGS. 4 and 5. Bolts 61 rigidly affix the control box 60 to the lower latch assembly 26 as shown in FIG. 3. Guide block 72 shown in greater detail in FIG. 6 is rigidly attached to control box 60 and provides a guide for maintaining the control piston 62 in substantially vertical position during operation of the chain jack.

Figure 7:
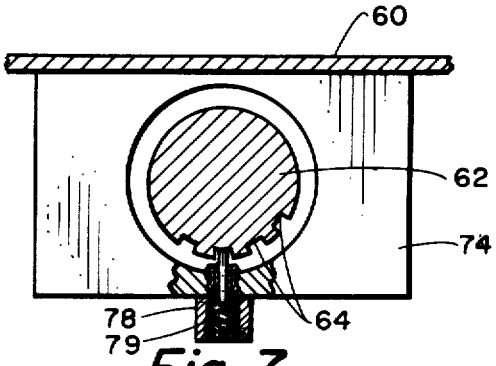
FIG. 7 is a horizontal section of the chain jack embodiment of FIG. 2 taken along line 7—7 of FIG. 2.
Figure 11:
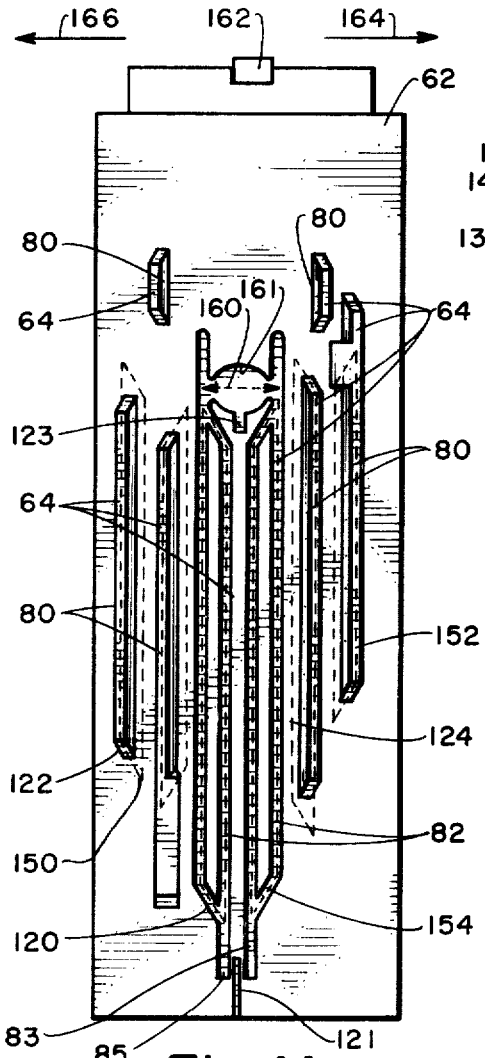
FIG. 11 is a front view of the control piston shown in the embodiment of FIG. 2 illustrating the logic surfaces thereon.

Referring to FIGS. 2, 7 and 11, the control piston 62 has logic surfaces, identified in general by reference numeral 64, which include both raised surfaces 80 and recessed surfaces 82. A control pin support member 74, located immediately below guide block 72 and also rigidly affixed to the control box 60, holds a control pin 78 in spring-biased engagement with the surface of the control piston 62 by means of a spring 79 (see FIG. 7). Cam followers 68 and 70 (See FIG. 2) also engage the surface of control piston 62.

Turning now to FIG. 11, the control piston 62 is illustrated in greater detail. In addition to the recessed logic surfaces 82 and the raised logic surfaces 80, the control piston 62 has recessed grooves 121 and 123 to permit the insertion or removal of the piston from the control box 60. The inner ends (i.e., the ends toward center of the piston) of grooves 121 and 123 slope from the depth of the recessed surfaces to the piston surface. When the control piston is inserted in the control box 60, the piston is aligned so that the spring biased control pin enters groove 121. As the control piston 62 is lowered during insertion, the control pin 78 rides up the sloped surface of groove 121 and onto the surface of the control piston 62 between the recessed logic surfaces 82. The control piston 62 may then be rotated manually via switching rod 162 (see FIG. 3) about its longitudinal axis so that the control pin 78 falls into the appropriate recessed logic surface 82 for the desired mode of operation as explained hereinafter in connection with FIGS. 13, 14 and 15. When the control pin 78 is in recessed logic surfaces 82, vertical motion of the control piston relative to the control box 60 and thus the vertical motion of the control piston relative to the control pin 78 (since the control pin and control box are rigidly coupled together via the control pin support member 74), causes the control piston 62 to rotate according to the horizontal travel of the recessed logic surfaces 82. This rotation of the control piston in turn causes the cam followers 68 and 70 to engage the piston surface and the raised logic surfaces 80 in the appropriate manner.

Groove 123 enables removal of the control piston 62 when the control pin 78 is in mode switching groove 161. During removal, the control pin 78 will automatically center on groove 123 and will ride up the sloped surface of groove 123 and onto the surface of the control piston 62 between the recessed logic sufaces 82. At this point, the piston may be rotated about its longitudinal axis to fall into a selected recessed surface or may be pulled out of the control box as desired.

The lower ends 83 and 85 of recessed surfaces 82 are also sloped to facilitate exit of the control pin 78 therefrom onto the surface of the control piston.

Figure 4:
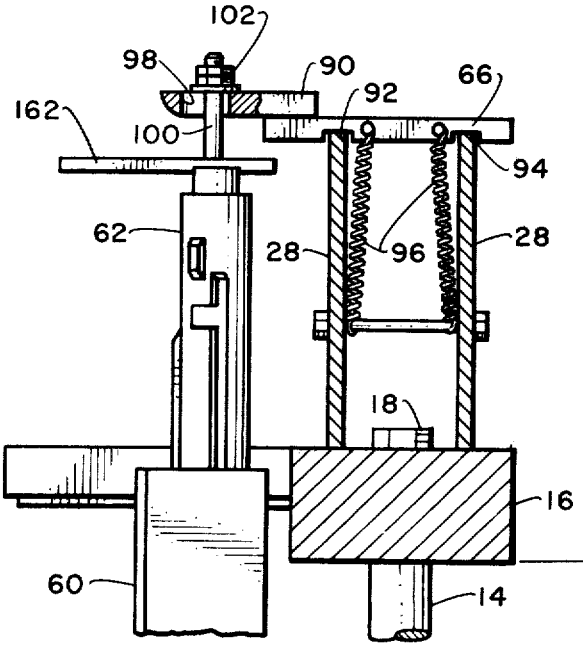
FIG. 4 is a partial side view of the embodiment of FIG. 1 illustrating the compensation system.
Figure 5:
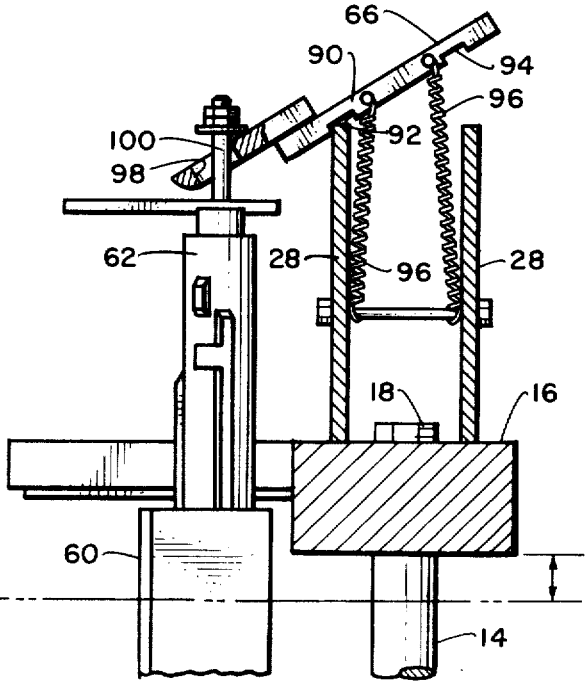
FIG. 5 is a partial side view of the embodiment shown in FIG. 1 illustrating the compensation system.

Now turning to FIGS. 4 and 5 compensator system 66 is illustrated in greater detail. Compensator system 66 includes support member 90 which contains a pair of grooves, 92 and 94, in which support members 28 ride. Support member 90 is held in abutting relationship with respect to support members 28 by means of spring biasing by springs 96. Support member 90 also provides an opening 98 through which pin 100 of control piston 62 extends. A nut and washer arrangement 102 provides a pivotable connection between control piston 62 and support member 90. The modulus of elasticity of springs 96 is great enough during normal operational movements to control piston 62 to maintain support member 90 in the position shown in FIG. 4. However, should piston 62 be rendered immovable with respect to control box 60 support member 90 will pivot with respect to support member 28 about groove 92 with the modulus of elasticity of springs 96 being overcome before any physical damage occurs to pin 100 or control piston 62.

As shown in FIGS. 4 and 5, when upper latch assembly 16 moves upwards while control piston 62 is lodged or rendered immovable within control box 60 support member 90 pivots about groove 92 on support 28. However, if upper latch assembly 16 were moving downward instead of upward (as is the situation) illustrated in FIGS. 4 and 5) then support member 90 would pivot with respect to support member 28 about groove 94. It is noted that opening 98 in support member 90 is suitably dimensioned to allow support member 90 to pivot with respect to pin 100 without physically damaging the same.

Figure 12:
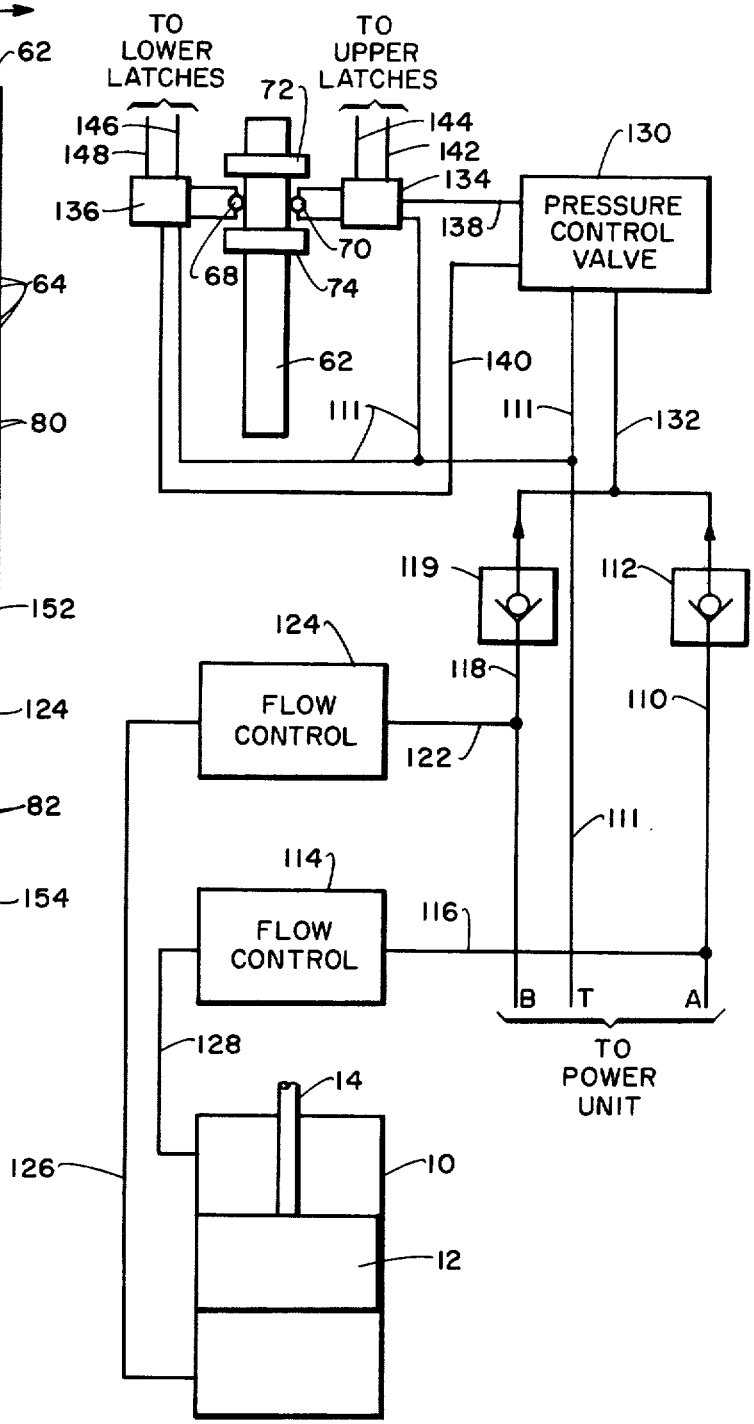
FIG. 12 is a schematic diagram of the hydraulic system utilized in the embodiments illustrated in FIGS. 1 and 2.

Now turning to FIG. 12 the control equipment contained within control box 60 is illustrated in schematic form. Hydraulic fluid enters one of two quick disconnects A or B depending on the jack cycle condition, i.e., either retract or extend. For the retraction cycle hydraulic fluid enters port or quick disconnect A. The fluid entering port A is directed via line 110 to check valve 112 and to flow control 114 via line 116. Flow control valves 114 and 124 limit the rate of flow of hydraulic fluid to hydraulic cylinder 10.

Hydraulic fluid entering port B is directed to check valve 119 via line 118 and to flow control valve 124 via line 122. The fluid from flow control 124 is directed to the underside of piston 12 through line 126 while the hydraulic fluid from flow control valve 114 is directed to the upper side of piston 12 via line 128.

It is noted that due to the placement of check valves 119 and 112 that fluid entering port A is restricted to flow through flow control valve 114 (being prevented from flowing through flow control valve 124) while hydraulic fluid entering port B is restricted to flow through control valve 124 (being prevented from flowing through control valve 114). Thus, hydraulic fluid entering port A serves to retract piston 12 thereby moving upper latch assembly 16 downwards toward lower latch assembly 26. Likewise, hydraulic fluid entering port B extends piston 12 thereby moving upper latch assembly 16 upward away from lower latch assembly 26.

The hydraulic fluid from check valves 119 and 112 is coupled to pressure control valve 130 via line 132. Pressure control valve 130 limits the flow of hydraulic fluid to a maximum pressure for operation of latch mechanisms 40 through 43. Hydraulic fluid from pressure control valve 130 is directed to four-way cam operated valves 134 and 136 via lines 138 and 140, respectively. The hydraulic fluid is directed through four-way valves 134 and 136 depending upon the position of cam followers 68 and 70 which activate the valve spools disposed within valves 134 and 136. The hydraulic fluid from pressure control valve 130 passes through four-way valves 136 and 134 to hydraulic cylinders 50 of latch mechanisms 40 through 43 via lines 142 through 148. Four-way valve 134 provides hydraulic fluid to upper latch mechanisms 40 and 41 while four-way valve 136 provides hydraulic fluid to lower latch mechanisms 42 and 43.

The hydraulic fluid is supplied to the hydraulic system by power control console not shown. In addition, tank return lines 111 to the power source are shown in FIG. 12 and designated by port T. Such lines ae commonly employed in the hydraulic art by those having ordinary skill in the art.

Figure 15:
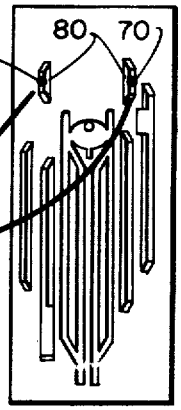
FIG. 15 illustrates the operation of the upper latch mechanisms and the lower latch mechanisms in the load mode.
Figure 13:
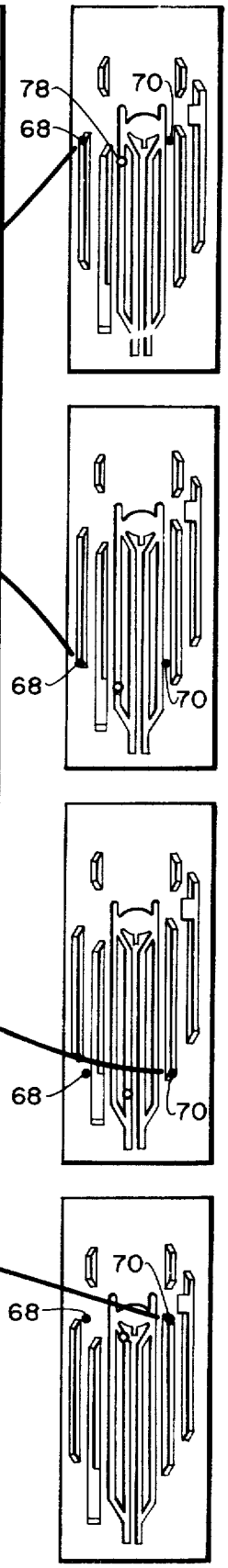
FIG. 13 illustrates the operation of the upper and lower latch mechanisms in the lift mode.
Figure 14:
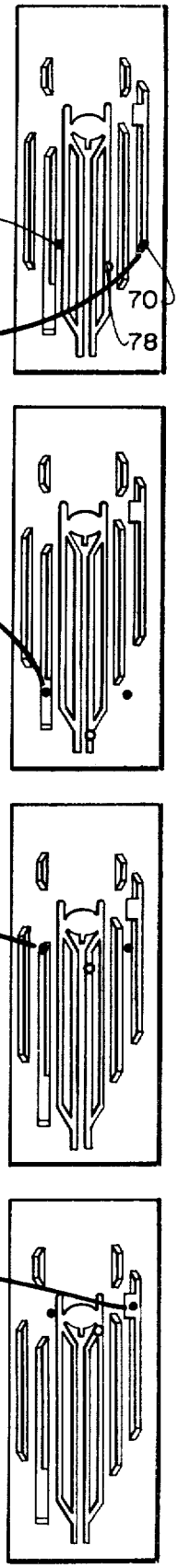
FIG. 14 illustrates the operation of the upper latch and lower latch mechanisms in the lower mode.

Now turning to FIGS. 13, 14 and 15 the operation of the upper latch mechanisms 40 and 41 and the lower latch mechanisms 42 and 43 is illustrated by showing the position of the upper latch mechanisms 40 and 41 and the lower latch mechanisms 42 and 43 with respect to the positional engagement of cam followers 68 and 70 on the raised logic surfaces 80 of control piston 62. The position column indicates the position of the latches just prior to actuation. The action column indicated the actuation of the latches. Each mode has an extend and a retract stroke.

FIG. 13 illustrates the lift mode, i.e., chains 34 moving upward with respect to lower latch assembly 26, while FIG. 14 illustrates the lower mode, i.e., chains 34 moving downwards with respect to lower latch assembly 26. Both the lower mode FIG. 14, and the lift mode, FIG. 13 include extend and retract strokes. During the extend stroke upper latch assembly 16 moves upward from lower latch assembly 26 while during the retract stroke upper latch assembly 16 moves downward toward lower latch assembly 26. The upper latch columns of FIG. 13 and FIG. 14 indicate the operation of latch mechanisms 40 and 41 while the lower latch columns of FIG. 13 and FIG. 14 indicate the operation of latch mechanisms 42 and 43.

It is noted that during the extend stroke hydraulic fluid or pressure is directed from the power unit (See FIG. 12) through port B of FIG. 12. Conversely, during the retract stroke hydraulic fluid or pressure is directed from the power unit (see FIG. 12) through Port A of FIG. 12. The translational movement of the control piston 62 is coupled directly to the translational movement of the hydraulic piston 12 in hydraulic cylinder 10 which are dimensioned according to the physical characteristics of the specific chain 34 being used. The logic surfaces 64 are in turn dimensioned to couple the movement of latches 40–43 to the stroke of the hydraulic piston 12. During actual lifting and lowering, the control pin 78 will ride in the recessed logic surfaces 82 of control piston 62.

More particularly, FIG. 13 illustrates the lift mode of the chain jack. During the lift mode of the chain jack the chain 34 moves progressively upwards with respect to lower latch assembly 26. It is noted that control pin 78 traverses a path within recessed surfaces 82 indicated by the dotted line labeled 120 in FIG. 11. Cam follower 68 which controls the operation of lower latch mechanisms 42 and 43 traverse a path indicated by the dotted line 122 of FIG. 11 while the cam follower 70 which controls the operation of the upper latch mechanisms 40 and 41 traverse a path indicated by the dotted line 124 in FIG. 11. The position of the cam followers 68 and 70 is indicated by the darkened dots in FIG. 13 while the position of control pin 78 is indicated by the white dot in FIG. 13. When cam followers 68 and 70 ride on raised surfaces 80 the latch mechanisms 40 through 43 are actuated to disengage chains 34. In contradistinction, when cam followers 68 and 70 ride on the surface of control piston 62 the latch mechanisms 40 through 43 are actuated to engage chains 34.

At the start of the lift mode with upper latch assembly 16 at its lowest level or zero position with respect to lower latch assembly 26 piston 12 within hydraulic cylinder 10 is in its completely retracted position. Upper latch mechanisms 40 and 41 as well as lower latch mechanisms 42 and 43 are both engaged with chains 34. Hydraulic fluid enters port B and is directed to the underside of piston 12 through flow control valve 124. This begins to raise or extend upper latch assembly 16. Once upper latch assembly 16 moves approximately one inch taking the load on chains 34, lower latch mechanisms 42 and 43 disengage chains 34 as cam 68 moves up onto raised surface 80 of control piston 62. Upper latch assembly 16 then moves upwards with the chain load being maintained by the upper latch mechanisms 40 and 41. Upon reaching 12 inches of extension, cam follower 68 exits raised surface 80 on path 122 thereby actuating lower latch mechanisms 42 and 43 to engage chain 34. Latch pins 44 of lower latch mechanisms 42 and 43 are able to fully extend within holes 46 thereby rendering them capable of supporting the load on chains 34. Upper latch assembly 16 continues upwards to its fully extended position at 13½ inches. During the extend stroke cam follower 70 has ridden along that portion of dotted line 124 on the surface of control piston 62 thereby maintaining upper latch mechanisms 40 and 41 in engagement with chains 34.

Hydraulic fluid for the retraction stroke enters port A and the upper side of piston 12 through flow control 114 thereby driving piston 12 downwards. On the retraction stroke when upper latch assembly reaches 12 inches the chain load is transferred from upper latch assembly 16, to lower latch assembly 26. The cam follower 70 following path 124 moves up onto raised surface 80 thereby actuating upper latch mechanisms 40 and 41 to disengage chain 34 while lower latch mechanisms 42 and 43 remain engaged with chains 34 since cam follower 68 continues to ride on the surface of control piston 62 along path 122. Upper latch assembly 16 continues its retraction down to 1 inch of the stroke with slack chains 34 moving through circumform openings 18 and 20 and passing over sheaves 32. Upon upper latch assembly 16 reaching the stroke of 1 inch, cam follower 70 following path 124 in FIG. 11 exits raised surface 80 thereby actuating upper latch mechanisms 40 and 41 for engagement with chain 34. After upper latch assembly 16 has retracted to zero of the stroke the cycle is ready to begin anew. Thus, during the lift mode chain 34 is progressively moved upwards with respect to lower latch assembly 26.

Now turning to FIG. 14 the lower mode is illustrated. In the lower mode, control pin 78 rides within recessed logic surfaces 82 along a path shown by dotted line 154 in FIG. 11 while cam followers 68 and 70 ride along paths shown by respective dotted lines 150 and 152 in FIG. 11.

In order to move from the lift mode to the lower mode or vice versa a switching rod 162 as shown in FIG. 3 is rigidly mounted on control piston 62 so as to allow manual rotation of control piston 62 about its longitudinal axis. Upper latch assembly 16 is fully retracted and control pin 78 is disposed adjacent switch groove 161. At this point, switching rod 162 is manually moved in the direction of arrow 166 if it is desired to change from the lift mode to the lower mode or in the direction of arrow 164 if it is desired to change from the lower mode to the lift mode. The dotted arrow 160 in FIG. 11 illustrates the movement of control pin 78 during the change from lower mode to lift mode or vice versa.

The operation of the upper latch mechanisms 40 and 41 and the lower mechanisms 42 and 43 are similar in both the lower mode and the lift mode. In the lower mode, cam follower 68 follows a path shown by the dotted line 150 in FIG. 11 which cam follower 70 follows a path shown by the dotted line 152 in FIG. 11. Control pin 78 follows a path shown by the dotted line 154 in FIG. 11.

As can be illustrated by an analysis of FIG. 14 similar to that of FIG. 13 the logic surfaces 80 and 82 are disposed on the surface of control piston 62 such that latch mechanisms 40 through 43 are actuated to allow chains 34 to progressively move downward with respect to lower latch assembly 26.

Briefly, the lower mode can be described as follows. Starting at zero position of upper latch assembly 16 with respect to lower latch assembly 26, upper latch mechanisms 40 and 41 are disengaged from chain 34 while lower latch mechanisms 42 and 43 are engaged with chains 34. Upper latch assembly 16 moves upwards or extends until it reaches 12 inches at which time follower 70 exits raised surface 80 along path 152 thereby biasing upper latch mechanisms 40 and 41 to engage chains 34. Upon reaching 13½ inches of the stroke upper latch mechanisms 40 and 41 have lifted the loaded chains 34 at which time cam follower 68 moves upon raised surface 80 along path 150 thereby actuating lower latch mechanisms 42 and 53 to disengage chains 34.

Next, upper latch assembly 16 is retracted. Upon reaching 1 inch of the stroke lower latch mechanisms 42 and 43 are actuated to engage chains 34. Further retraction of piston 12 transfers the chain load from upper latch assembly 16 to lower latch assembly 26. Then upon reaching zero inches upper latch mechanisms 40 and 41 are actuated to disengage chains 34. The lower mode sequence is now ready to being anew.

The load mode is illustrated in FIG. 15. As is shown, the cam followers 68 and 70 are disposed to ride upon raised logic surfaces 80 of control piston 62 by manually tilting support member 90 such that control piston 62 is lowered in control box 60 through guide block 72 thereby rendering both the upper latch mechanisms 40 and 41 and the lower latch mechanisms 42 and 43 disengaged from the chains 34.

Returning to FIG. 10 it is noted that the bias force exerted on latch pin 44 by hydraulic cylinder 50 is insufficient to move and disengage latch pins 44 from chain 34 when the chain load is supported by that latch. However, when the load is transferred to the upper latch mechanisms 40 and 41 the bias force is sufficient to retract latch pins 44 thereby disengaging latch mechanisms 42 and 43 from chains 34. Engagement and disengagement of latch mechanisms 40 through 43 with chains 34 takes place slightly before the end of each stroke of piston 12. A slight amount of over travel is provided in each ram stroke which is principally necessary in the lower mode of operation. The over travel insures that the upper latch assembly travels a slight additional distance each time so that latch mechanisms 40 through 43 can engage or disengage with a chain link such that the link seated in the saddle formed by notches 45 in latch pins 44 of one latch assembly will be moved a sufficient extra distance so that the latch and link of the other latch mechanism will clear each other. Engaged or disengaged latch mechanisms 40 and 41 are moved in appropriate distance to clear the link and allow proper seating in the saddle at commencement of the following stroke.

The double chain jack of this invention is advantageous in that a single hydraulic cylinder and ram is employed between a pair of chains. Therefore, the load on the ram and hydraulic cylinder is balanced and is wholly vertical. This makes possible the simplest form of hydraulic actuating equipment without need for providing devices to counteract side or off center loads. Thus, cylinder, ram and associated structure may be considerably lighter and less expensive than if side or off center loads would have to be counteracted. A single ram arrangement with balanced load is of course of substantially lower cost than employment of a double ram assembly proposed and used in the prior art.

The upper and lower latch assemblies can be constructed of heavy material to serve as a convenient mount for the jack. This will allow complete disassembly of the cylinder and its pistons in the ram assembly while the load is supported by the latches in the upper or lower latch assemblies. This is a maintenance advantage in event of a seal leak.

The latch pins as described are preferably fabricated of cylindrical barstock with flat surfaces in the areas that the pins contact the chain links. This provides a greater area of surface contact and distribution of load over both sides of the chain. The chain jack with chain loads not biased, i.e., with loads evenly distributed between the two chains, may be used for operation in horizontal attitude in which case the sheaves carrying the chains may not be utilized.

Employment of the bar type latches contacting the undersides of the links of the chain is additionally advantageous because this organization permits use of chains assembled from links each having a central cross bar and often referred to as stud link chain, i.e., chain 34. The latches produced from round bar stock are strong and inexpensive to fabricate and their flattened surfaces as described provide areas for effective distribution of the lifting or moving loads.

Obviously, numerous modifications and variations of the present invention are possible in light of the above teachings. It is therefore to be understood that within the scope of the appended claims the invention may be practiced otherwise than as specifically described herein.

What is claimed is:

1. A chain jack comprising:

a. at least one chain;

b. an upper latch assembly having latches for selectively engaging and disengaging the links of said chain;

c. a lower latch assembly having latches for selectively engaging and disengaging the links of said chain;

d. means for imparting relative movement between said upper and lower latch assemblies;

e. means for actuating said latches in and out of engagement with the links of said chain;

f. a control piston having logic surfaces thereon, said piston being connected to move with said upper latch assembly;

g. a pair of followers engageable with said logic surfaces;

h. a control pin engageable with said logic surfaces for controlling the engagement of said followers with said logic surfaces, said control pin being stationary with respect to said lower latch assembly;

i. hydraulic means connected to said followers for controlling the movement of said latches in and out of engagement with said chain at predetermined relative positions of said control piston and said pin; and j. whereby the movement of said latches in conjunction with the relative movement of said upper and lower latch assemblies results in progressive relative movement between said chain and said lower latch assembly.

2. The apparatus of claim 1 wherein said relative movement imparting means includes a hydraulic cylinder having a movable piston therein with a ram attached thereto, said ram being coupled to said upper latch assembly and said hydraulic cylinder being coupled to said lower latch assembly.

3. The apparatus of claim 1 wherein said logic surfaces of said control piston include at least one raised cam surface for engagement with said followers and at least one recessed surface for engagement with said control pin.

4. The apparatus of claim 1 wherein said control piston includes:

a. at least one cam surface located on said control piston for controlling upward movement of said chain with respect to said lower latch assembly;
b. at least one cam surface located on said control piston for controlling downward movement of said chain with respect to said lower latch assembly;
c. at least one recessed surface located on said control piston for controlling upward movement of said chain with respect to said lower latch assembly; and
d. at least one recessed surface located on said control piston for controlling downward movement of said chain with respect to said lower latch assembly.

5. The apparatus of claim 1 further including compensation means disposed between said control piston and said upper latch assembly for insuring the physical integrity of said control piston should said control piston be rendered immovable with respect to said lower latch assembly.

6. The apparatus of claim 5 wherein said compensation means includes a support member pivotally connected to said control piston and spring-bias mounted via at least one spring to said upper latch assembly such that during normal operation the modulus of elasticity of said spring retains said support member in a first position with respect to said upper latch assembly, but, upon said control piston being rendered immovable with respect to said upper latch assembly, the modulus of elasticity of said spring is overcome forcing said support member to pivot with respect to said control piston as said upper latch assembly moves thereby preventing physical damage to said control piston.

7. The apparatus of claim 1 further including means disposed adjacent said control piston for maintaining said control piston in proper operational position.

8. The apparatus of claim 7 wherein said position maintaining means includes a guide block having a hole therethrough, said control piston being disposed to ride within said guide block hole.

9. The apparatus of claim 1 wherein said logic surfaces of said control piston provides:

a. a lift mode wherein said chain moves upward with respect to said lower latch assembly;
b. a lower mode wherein said chain moves downward with respect to said lower latch assembly; and
c. a load mode wherein said chain may move with respect to said lower latch assembly.

10. The apparatus of claim 9 wherein said control piston includes means coupled thereto for switching said control piston between said lift and said lower mode.

11. The apparatus of claim 1 wherein said control piston includes:

a. at least one cam surface for engaging one of said followers during a portion of the upward movement of said chain with respect to said lower latch assembly;
b. at least one cam surface for engaging the other of said followers during a portion of the downward movement of said chain with respect to said lower latch assembly;
c. at least one recessed surface for engaging said control pin during a portion of the upward movement of said chain with respect to said lower latch assembly; and
d. at least one recessed surface for engaging said control pin during a portion of the downward movement of said chain with respect to said lower latch assembly.

12. A chain jack comprising:

a. two chains;
b. an upper latch assembly having latches for selectively engaging and disengaging the links of said chains;
c. a lower latch assembly having latches for selectively engaging and disengaging the links of said chains;
d. means for imparting relative movement between said upper and lower latch assemblies;
e. means for actuating said latches in and out of engagement with the links of said chains;
f. a control piston having logic surfaces thereon, said piston being connected to move with said upper latch assembly;
g. a pair of followers engageable with said logic surfaces;
h. a control pin engageable with said logic surfaces for controlling the engagement of said followers with said logic surfaces, said control pin being stationary with respect to said lower latch assembly;
i. hydraulic means connected to said followers for controlling the movement of said latches in and out of engagement with said chains at predetermined relative positions of said control piston and said pin; and
j. whereby the movement of said latches in conjunction with the relative movement of said upper and lower latch assemblies results in progressive relative movement between said chains and said lower latch assembly.

13. The apparatus of claim 12 wherein:

a. said upper and lower latch assemblies each have a pair of cruciform apertures therethrough, one on each end of said assemblies, said cruciform aperture in said upper latch assembly being vertically aligned with corresponding cruciform aperture in said lower latch assembly;
b. said two chains passing through said cruciform apertures, one on each end of said upper and lower latch assemblies; and
c. said upper and lower latch assemblies each have a pair of parallel spaced apart latch pins slidably mounted in horizontal holes in each of said latch assemblies, each latch pin being disposed in the way of a cruciform aperture for selectively engaging and disengaging said chains passing through said cruciform apertures.

14. The apparatus of claim 13 wherein the upper free ends of said chains pass over sheaves rotatably mounted on said upper latch assembly.

* * * * *